US009187936B2

(12) United States Patent
Kim et al.

(10) Patent No.: US 9,187,936 B2
(45) Date of Patent: Nov. 17, 2015

(54) TWO STEP LINK HOOD LATCH APPARATUS FOR VEHICLE

(71) Applicants: Hyundai Motor Company, Seoul (KR); Kia Motors Corporation, Seoul (KR)

(72) Inventors: Sang Il Kim, Hwaseong-si (KR); Chung Hwa Jung, Hwaseong-si (KR); Chang Gi Ha, Hwaseong-si (KR); Ki Ryun Ahn, Daegu (KR); Mun Bae Tak, Daegu (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 13/707,101

(22) Filed: Dec. 6, 2012

(65) Prior Publication Data

US 2014/0062098 A1 Mar. 6, 2014

(30) Foreign Application Priority Data

Sep. 5, 2012 (KR) ..... 10-2012-0098188

(51) Int. Cl.

| | |
|---|---|
| ***E05C 9/00*** | (2006.01) |
| ***E05B 83/24*** | (2014.01) |
| *E05C 3/06* | (2006.01) |
| *E05C 3/16* | (2006.01) |
| *E05C 3/04* | (2006.01) |
| *E05B 83/16* | (2014.01) |

(52) U.S. Cl.

CPC ..... *E05B 83/24* (2013.01); *E05B 83/16* (2013.01); *Y10T 292/083* (2015.04)

(58) Field of Classification Search

CPC ..... E05B 83/24; E05B 83/16; Y10S 292/14; E05C 9/22

USPC ..... 292/28, 202, 201, 216, 210, DIG. 23, 292/DIG. 42, DIG. 43

See application file for complete search history.

(56) References Cited

U.S. PATENT DOCUMENTS

| | | | | | |
|---|---|---|---|---|---|
| 2,256,465 | A | * | 9/1941 | Brubaker | 292/28 |
| 2,268,741 | A | * | 1/1942 | Dall | 292/117 |
| 3,905,624 | A | * | 9/1975 | Fujita | 292/11 |
| 4,045,064 | A | * | 8/1977 | Okada | 292/125 |
| 4,875,724 | A | * | 10/1989 | Gruber | 292/216 |
| 4,936,611 | A | * | 6/1990 | Palvolgyi | 292/28 |

(Continued)

FOREIGN PATENT DOCUMENTS

| | | | |
|---|---|---|---|
| KR | 1020040055225 | A | 6/2004 |
| KR | 1020070024986 | A | 3/2007 |

(Continued)

*Primary Examiner* — Kristina Fulton
*Assistant Examiner* — Faria Ahmad
(74) *Attorney, Agent, or Firm* — Morgan, Lewis & Bockius LLP

(57) ABSTRACT

A two step link hood latch apparatus for a vehicle allows a hood to be opened only with an operation of a release handle inside a vehicle. The apparatus includes a claw, the pawl, a pivot, and a link. The claw is disposed at a base plate to be rotatable, restrains a hood striker through a stop groove, and is restrained to a pawl through first and second stop ends in first step and second step lock states. The pawl is disposed at the base plate to be rotatable, and restrains the rotation of the claw in steps by using the stop protrusion. The pivot is disposed at the base plate to be rotatable in a hinge structure, and transmits a pulling force generated from the release handle. The link connects the pivot and the pawl and rotates the pawl in linkage with the pivot.

5 Claims, 9 Drawing Sheets

(56) References Cited

U.S. PATENT DOCUMENTS

| | | | | | |
|---|---|---|---|---|---|
| 5,074,603 | A * | 12/1991 | Brackmann | 292/216 |
| 5,118,146 | A * | 6/1992 | Watanuki | 292/216 |
| 5,273,325 | A * | 12/1993 | Zimmermann | 292/216 |
| 5,288,115 | A * | 2/1994 | Inoue et al. | 292/201 |
| 5,411,302 | A * | 5/1995 | Shimada | 292/201 |
| 5,474,338 | A * | 12/1995 | Buscher | 292/201 |
| 5,531,488 | A * | 7/1996 | Yoshikuwa et al. | 292/216 |
| 5,537,848 | A * | 7/1996 | Grzanka et al. | 70/279.1 |
| 5,544,925 | A * | 8/1996 | Ikeda | 292/216 |
| 5,564,761 | A * | 10/1996 | Mizuki et al. | 292/201 |
| 5,738,393 | A * | 4/1998 | Chao | 292/216 |
| 5,961,164 | A * | 10/1999 | Gomi | 292/216 |
| 5,997,055 | A * | 12/1999 | Strathmann | 292/201 |
| 6,059,327 | A * | 5/2000 | Yoshikuwa | 292/216 |
| 6,072,403 | A * | 6/2000 | Iwasaki et al. | 340/5.72 |
| 6,106,033 | A * | 8/2000 | Ruckert | 292/216 |
| 6,109,670 | A * | 8/2000 | Tomaszewski et al. | 292/216 |
| 6,382,687 | B1 * | 5/2002 | Gruhn | 292/201 |
| 6,485,071 | B2 * | 11/2002 | Schwaiger | 292/216 |
| 6,519,986 | B2 * | 2/2003 | Wicker | 70/237 |
| 6,575,006 | B1 * | 6/2003 | Don | 70/472 |
| 6,575,507 | B2 * | 6/2003 | Reddmann | 292/216 |
| 6,648,380 | B1 * | 11/2003 | Szablewski et al. | 292/201 |
| 6,695,360 | B1 * | 2/2004 | Forsell et al. | 292/216 |
| 6,698,803 | B2 * | 3/2004 | Furlong | 292/165 |
| 6,945,585 | B1 * | 9/2005 | Liu et al. | 296/65.03 |
| 7,748,758 | B2 * | 7/2010 | Fang et al. | 292/347 |
| 7,770,946 | B2 * | 8/2010 | Kouzuma | 292/201 |
| 8,029,030 | B2 * | 10/2011 | Shimura et al. | 292/216 |
| 8,186,730 | B2 * | 5/2012 | Berghahn et al. | 292/201 |
| 8,333,530 | B2 * | 12/2012 | Omori | 403/330 |
| 8,596,694 | B2 * | 12/2013 | Taurasi et al. | 292/201 |
| 8,764,075 | B2 * | 7/2014 | Taurasi et al. | 292/216 |
| 8,882,160 | B2 * | 11/2014 | Kamata et al. | 292/216 |
| 8,955,889 | B2 * | 2/2015 | Bendel et al. | 292/200 |
| 2005/0035604 | A1 * | 2/2005 | Coleman et al. | 292/216 |
| 2006/0028029 | A1 * | 2/2006 | Spurr | 292/216 |
| 2006/0226661 | A1 * | 10/2006 | Moore | 292/216 |
| 2006/0284426 | A1 * | 12/2006 | Bigazzi et al. | 292/216 |
| 2007/0200357 | A1 * | 8/2007 | Westerwick et al. | 292/201 |
| 2008/0203737 | A1 * | 8/2008 | Tomaszewski et al. | 292/216 |
| 2008/0217929 | A1 * | 9/2008 | Zweibohmer | 292/216 |
| 2008/0224482 | A1 * | 9/2008 | Cumbo et al. | 292/216 |
| 2009/0025438 | A1 * | 1/2009 | Don et al. | 70/224 |
| 2010/0026014 | A1 * | 2/2010 | Machida et al. | 292/216 |
| 2014/0246870 | A1 * | 9/2014 | Kim et al. | 292/216 |
| 2014/0319852 | A1 * | 10/2014 | Shimura et al. | 292/216 |

FOREIGN PATENT DOCUMENTS

| | | | |
|---|---|---|---|
| KR | 1020090063821 | A | 6/2009 |
| KR | 10-1022207 | B1 | 3/2011 |

* cited by examiner

TWO STEP LINK HOOD LATCH APPARATUS FOR VEHICLE

CROSS-REFERENCE TO RELATED APPLICATION

The present application claims priority of Korean Patent Application Number 10-2012-0098188 filed Sep. 5, 2012, the entire contents of which application is incorporated herein for all purposes by this reference.

BACKGROUND OF INVENTION

1. Field of Invention

The present invention relates to a two step link hood latch apparatus for vehicle, which opens a hood only with indoor manipulation.

2. Description of Related Art

Vehicles have been recognized and developed as a mere transportation means or conveying equipments. However, due to the diverse consumer preferences, technological competition among vehicle manufacturers has been intensified to meet the various requirements.

Recently, vehicles have been evolving by putting more emphasis on the conveniences and services of a vehicle than on its appearance and design by developing control and convenience devices to provide more convenience for drivers.

A two step link hood latch apparatus has been developed to have more superior product competitiveness than other companies' products in the world market as well as the domestic market.

In general, since a hood has a two step locking structure using a safety hood, when a release lever is operated inside a vehicle in order to release a locked hood, a first step restraint is released with a cable operation, and then, a second step safety device for hood operation is prepared in order to open the hood with a safety lever's release after a user puts the hand in an engine room, standing in front of the vehicle.

This is provided for satisfying vehicle safety standard regulations. Accordingly, a firm hood latch apparatus needs to be installed at the hood of a vehicle, and also, the vehicle with a hood structure, in which the hood is opened/closed at the front direction and interferes with driver's visibility when the hood is opened during driving, is regulated with a two step locking or two spot locking structure.

FIG. 1 is an operational state view of a method of releasing a typical hood latch device. As shown in the first drawing, a hood striker 5 is double-locked by a claw 1 and a hook 2 in the initial state.

Then, as shown in the second drawing, when a driver operates a release lever disposed at the indoor driver's seat, a pawl 4 is pulled out in the arrow direction (→) of FIG. 1B and rotates, so that the restraint force applied to the claw 1 is released.

Then, as shown in the third drawing, as the claw 1 rotates, the striker 5 comes out from an insertion groove 1*a* of the claw 1 and thus the hood is slightly raised because a first lock state changes into a first open state.

Then, as shown in the drawing, when a driver steps out of a vehicle and then puts the hand inside the first opened hood and pushes the safety lever 3 toward the arrow direction of FIG. 1D, the hook 2 connected to the safety lever 3 rotates and the restraint force that holds the hood striker 5 is released, so that the hood changes from a secondary lock state into a secondary open state.

However, when a driver tries to open the hood, it is cumbersome and inconvenient for the driver to operate the release lever inside the vehicle in order to release the first lock, and then, step out of the vehicle in order to put the hand inside the hood and operate the safety lever 3.

Moreover, when a driver operates the release lever, the motion of the pawl 4 is directly passed to the driver through a cable, so that operability becomes poor.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention provides a two step link hood latch apparatus for vehicle, in which a first stop end and a second stop end of a claw are configured to be stopped by a stop protrusion of a pawl, operability (i.e., pulling force) occurring at a release handle is passed from wire to the pawl through a pivot and link, the stroke of the link is adjusted through a "U" shaped first and second step slots formed at the pawl, and the rotation of the claw is adjusted in two steps through a two step operation of the release handle. Accordingly, the hood is opened only with indoor manipulation, a predetermined operability is implemented, and inconveniently putting the hand in an engine room to open an existing hood is improved.

Various aspects of the present invention provide for a two step link hood latch apparatus for a vehicle, which allows a hood to be opened only with an operation of a release handle inside a vehicle, the apparatus including: a claw disposed at a base plate to be rotatable, restraining a hood striker through a stop groove, and restrained to a pawl through first and second stop ends in first step and second step lock states; the pawl disposed at the base plate to be rotatable and restraining the rotation of the claw in steps by using the stop protrusion; a pivot disposed at the base plate to be rotatable in a hinge structure and transmitting a pulling force generated from the release handle; and a link connecting the pivot and the pawl and rotating the pawl in linkage with the pivot.

The pawl may be connected to the link by using an operation axis as a medium, and may include first step and second stop slots formed being vertically spaced a predetermined distance apart from each other for the connection of the operation axis and a connection slot connecting the first step and second step slots; and when the hood changes from a first step lock state into a second step lock state or from a first step open state to a second step open state, the operation axis may move from the first step slot to the second step slot or from the second step slot to the first step slot, through the connection slot.

The pawl may include a first step slot and a second step slot at the connection part with the link. The rotation of the pawl may be adjusted by adjusting the stroke of the link through the lengths of the first step and second step slots.

The link may be connected to the pivot by using a third rotation axis as a medium, and may convert the rotary motion of the pivot into the horizontal linear motion to operate the pawl.

The link may have a link groove formed concavely on the upper surface with a smooth curvature. The claw may have a circular link restraint member. The link restraint member may contact the link groove to restrain the link.

The link may have a third spring disposed at the connection part with the pivot, and may move the operation axis of the link from the first step slot to the second step slot by using the third spring.

The present methods and apparatuses have other features and advantages apparent from the accompanying drawings, incorporated herein, and below Detailed Description, which together serve to explain certain principles of the present invention.

It should be understood that the appended drawings are not necessarily to scale, presenting a somewhat simplified representation of various features illustrative of the basic principles of the invention. Certain design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawings.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

Figure 1:
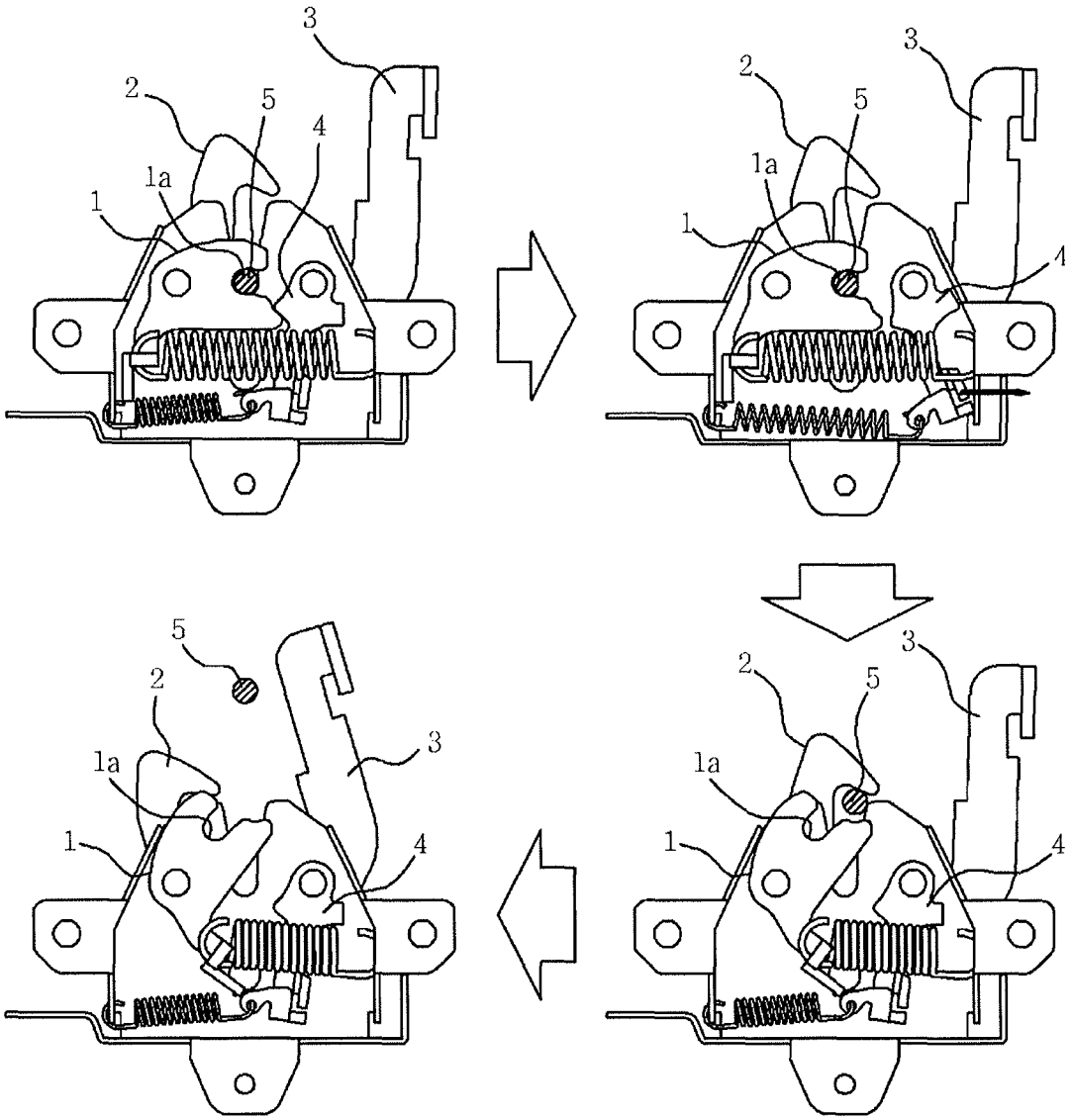
FIG. 1 is a view illustrating a method of releasing a typical hood latch device.
Figure 2:
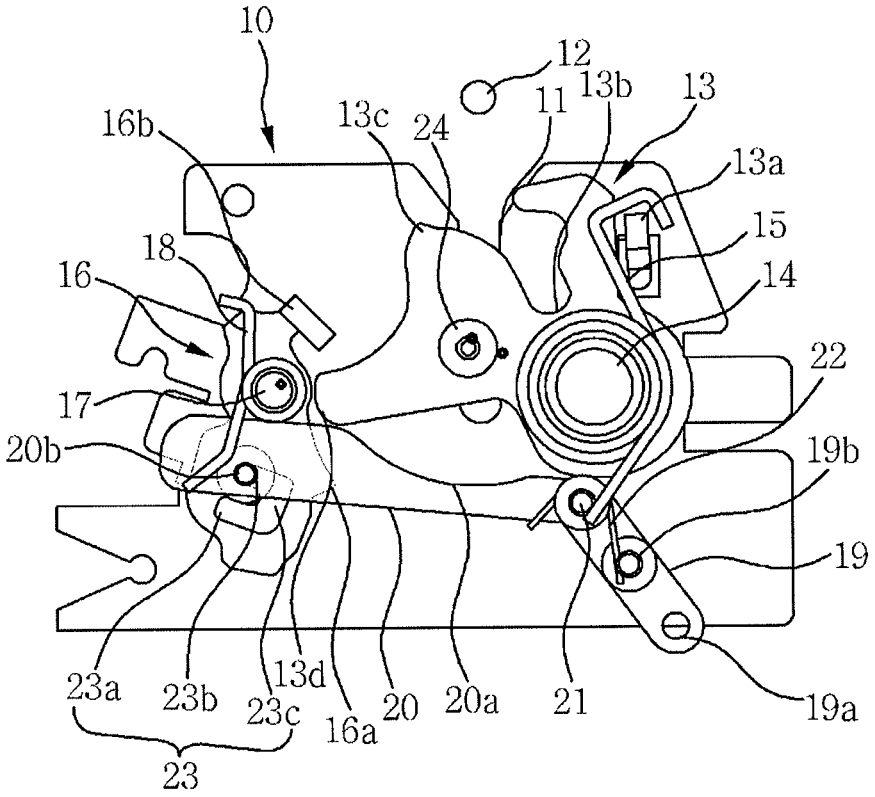
FIG. 2 is a view illustrating a configuration of an exemplary two step link hood latch apparatus according to the present invention.

FIG. 2 is a view illustrating a configuration of a two step link hood latch apparatus according to various embodiments of the present invention.

The present invention relates to a two step link hood latch apparatus, which performs a two step locking function on a hood latch itself so as to improve marketability.

The two step link hood latch apparatus may operate a release handle twice inside a vehicle so as to open the hood in two steps, so that when a driver opens the hood, cumbersomeness in operating a safety lever outside the vehicle may be improved.

For this, the two step link hood latch apparatus according to various embodiments of the present invention may include a base plate 10, a pawl 16, a claw 13, a link 20, and a pivot 19.

The base plate 10 may be vertically installed at the body front part, and an insertion groove 11 may be formed directly below the upper center of the base plate 10. When the hood is closed, a hood striker 12 may be inserted into the insertion groove 11, and when the hood is opened, the hood striker 12 may come out from the insertion groove 11.

The claw 13 may be hinge-coupled to a first rotation axis 14 installed at the right side of the base plate 10 and thus may be mounted on the base plate 10 to be rotatable. The claw 13 may be elastically supported by a first spring 15 installed at the first rotation axis 14, so that it may return to the initial position.

In this case, one end part of the first spring 15 may be fixed to a fixing protrusion 13*a* formed at one side of the upper part of the claw 13, and the other end part of the first spring 15 may be fixed to the base plate 10. Accordingly, when the hood is closed, the claw 13 may rotate downwardly as receiving the force from the hood striker 12, and when the hood is opened, the claw 13 may rotate upwardly due to elastic restoring force as the restraint force of the pawl 16 is released, and thus, the hood striker 12 may move upwardly.

In relation to the claw 13, a stop groove 13*b* may be formed at the right side of the upper left end part on the base plate 10. When the hood striker 12 is inserted into the stop groove 13*b*, the closed state of the hood may be maintained, and when the hood striker 12 comes out of the stop groove 13*b*, the hood may be opened.

The claw 13 may include a first stop end 13*c* protruding from the left middle and a second stop end 13*d* protruding therebelow. When the hood is opened, the first stop end 13*c* and the second stop end 13*d* may be sequentially stopped by the stop protrusion 16*a*, so that the rotation of the claw 13 is restrained in two steps.

The pawl 16 may include a stop protrusion 16*a* protruding at the right middle. Thus, the first stop end 13*c* and the second stop end 13*d* may be stopped by the stop protrusion 16*a*, thereby restraining the rotation of the claw 13.

Additionally, the upper part of the pawl 16 may be hinge-coupled to a second rotation axis 17 installed at the left side of the base plate 10 and thus its lower part may be rotatable at the base plate 10. The pawl 16 may be elastically supported by a second spring 18 installed at the second rotation axis 17, so that it may return to the initial position.

In this case, one end part of the second spring 18 may be fixed to a fixing protrusion 16*b* formed at the upper part of the pawl 16, and the other end part of the second spring 18 may be fixed to the base plate 10. Accordingly, when the hood is opened, the lower part of the pawl 16 may rotate to the left as the pawl 16 receives the force from the link 20, and when the pawl 16 is released from the force of the link 20, it may return to the original position.

Here, the present invention may further include a pivot 19 and a link 20 installed at the base plate 10 in order to open the hood by operating the release handle twice inside a vehicle.

The pivot 19 may have a rod shape having the greater height than the width, may have a connection aperture 19*a* at the lower part of the rod, and may be connected to a wire through the connection aperture 19*a*. The wire may be connected to the release handle inside a vehicle in order to connect the pivot 19 and the release handle.

The center part of the pivot 19 may be hinge-coupled to a pivot axis 19*b* installed at the base plate 10, and its upper part and lower part may be rotatable to the left and right on the basis of the center of the pivot axis 19*b*.

The link 20 may connect the pivot 10 and the pawl 16 horizontally, and thus, may pass the force from the release handle through the pivot 19 to the pawl 16.

The right end part of the link 20 may be connected to a third rotation axis 21 at the upper part of the pivot 19, and the left end part of the link 20 may be connected to an operation axis 20*b* at the lower part of the pawl 16, thereby rotating and moving the pawl 16 through the force passed through the pivot 19.

A third spring 22 may be installed at the third rotation axis 21 connected to the link 20 and the pivot 19. One end part of the third spring 22 may be fixed at the link 20, and the other end part of the third spring 22 may be fixed at the pivot 19. When the link 20 receives the force through the pivot 19 and horizontally moves to the left during hood opening, it may rotate the pawl 16. Also, when the release handle is released, the link 20 and the pivot 19 may return to the original positions and the link 20 may move upwardly due to the elastic restoring force of the third spring 22. That is, by doing so, a first step lock state may change into a second step lock state.

The pawl 16 may have a guide slot 23 formed at the lower part, and may be connected to the operation axis 20*b* of the link 20 through the guide slot 23 in order to guide the moving path of the operation axis 20*b*.

The guide slot 23 may include a first step slot 23*a* formed in the left and right horizontal direction, a second step slot 23*b* formed in the left and right horizontal direction, being spaced above the first step slot 23*a*, and a connection slot 23*c* for vertically connecting the first step slot 23*a* and the right end part of the second step slot 23*b* in order to change the lock state of the hood from the first step into the next second step.

The claw 13 may include a circle-shaped protruding link restraint member 24 in order to restrain the upward rotation of the link 20, and the link restraint member 24 may be coupled to the claw 13 through a pin. The claw 13, the first stop end 13*c*, and the second stop end 13*d* may form the vertices of a triangle.

Additionally, the link 20 may have a link groove 20*a* concavely formed at the upper surface with a smooth downward curvature, and the link groove 20*a* may convert the rotary motion of the pivot 20 into the horizontal linear motion of the link 20 through the contact with the outer circumference of the link restraint member 24.

An operational state of a two step link hood latch apparatus for vehicle having the above configuration according to the present invention will be described as follows.

Figure 3:
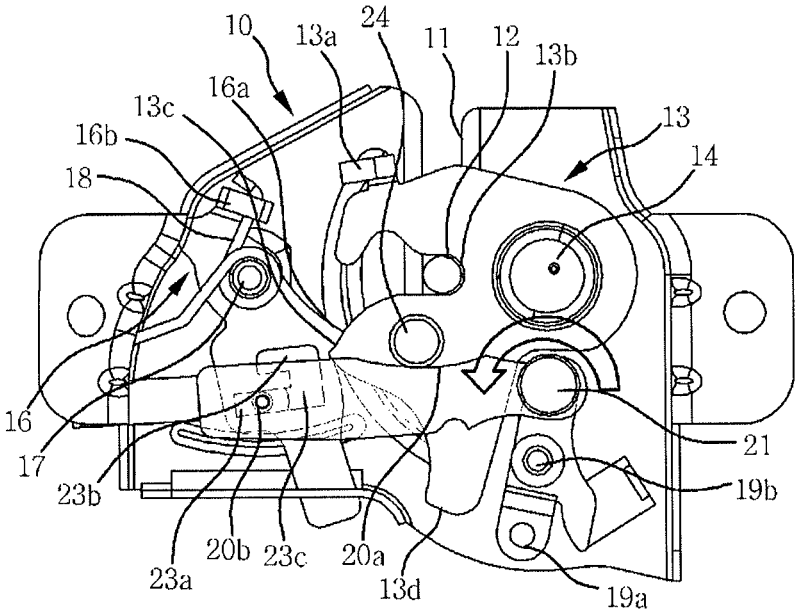
FIG. 3 is a view illustrating an operational state of an exemplary two step link hood latch apparatus when the hood is opened in FIG. 2.

FIG. 3 is a view illustrating an operational state of a two step link hood latch apparatus when the hood is opened in FIG. 2.

Figure 4:
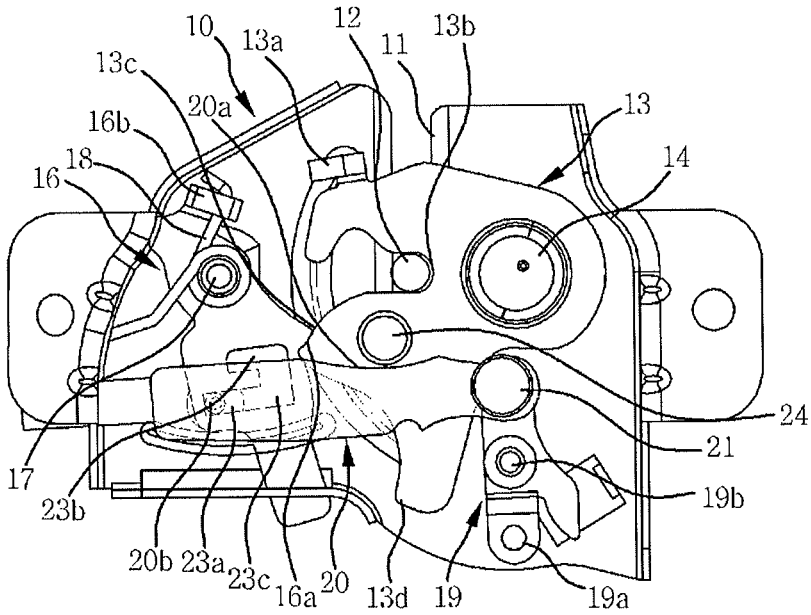
FIG. 4 is a view illustrating an operational state of an exemplary two step link hood latch apparatus when the hood is opened in FIG. 2.

FIG. 4 is a view illustrating an operational state of a two step link hood latch apparatus when the hood is opened in FIG. 2.

Figure 5:
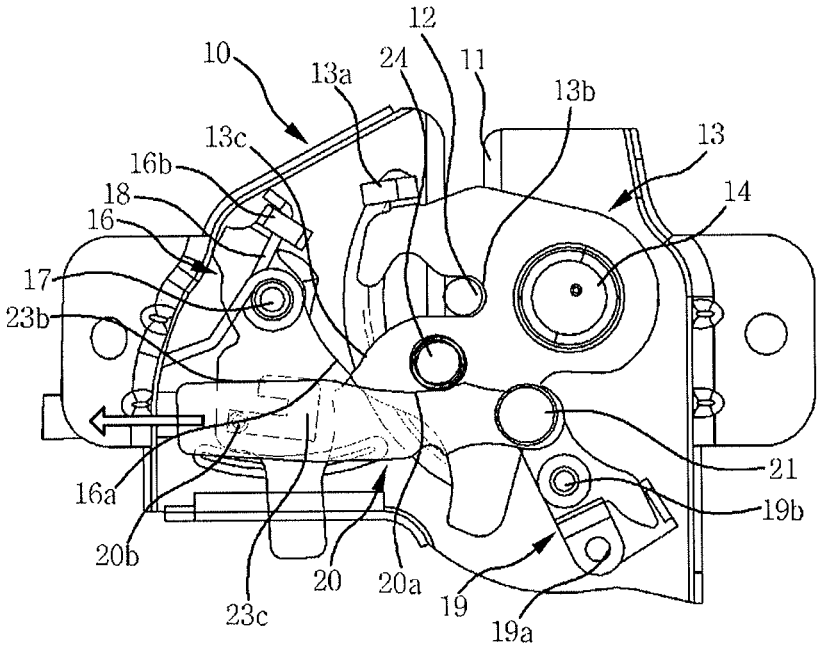
FIG. 5 is a view illustrating an operational state of an exemplary two step link hood latch apparatus when the hood is opened in FIG. 2.

FIG. 5 is a view illustrating an operational state of a two step link hood latch apparatus when the hood is opened in FIG. 2.

Figure 6:
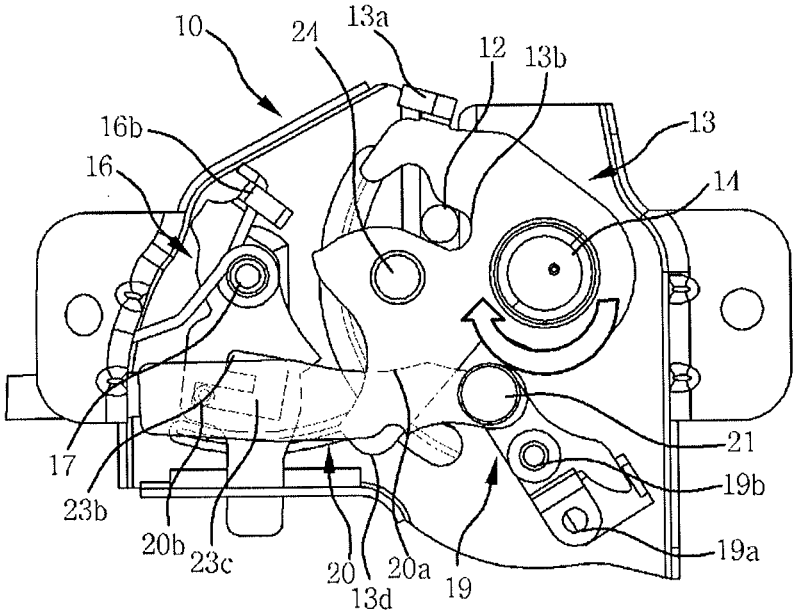
FIG. 6 is a view illustrating an operational state of an exemplary two step link hood latch apparatus when the hood is opened in FIG. 2.

FIG. 6 is a view illustrating an operational state of a two step link hood latch apparatus when the hood is opened in FIG. 2.

Figure 7:
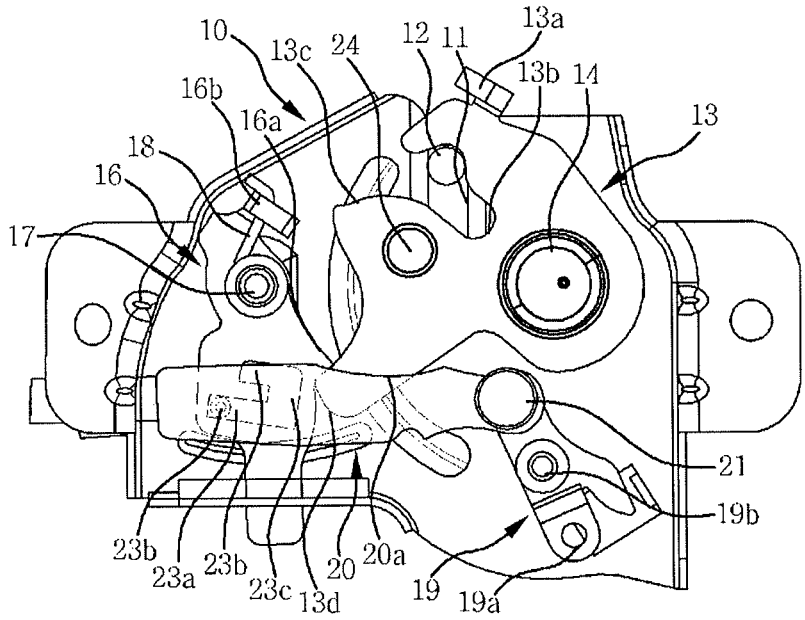
FIG. 7 is a view illustrating an operational state of an exemplary two step link hood latch apparatus when the hood is opened in FIG. 2.

FIG. 7 is a view illustrating an operational state of a two step link hood latch apparatus when the hood is opened in FIG. 2.

Figure 8:
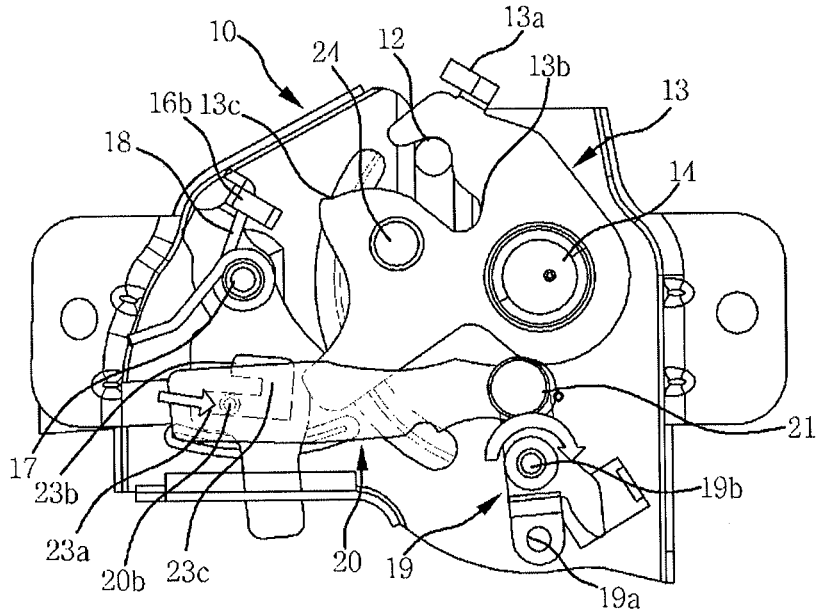
FIG. 8 is a view illustrating an operational state of an exemplary two step link hood latch apparatus when the hood is opened in FIG. 2.

FIG. 8 is a view illustrating an operational state of a two step link hood latch apparatus when the hood is opened in FIG. 2.

Figure 9:
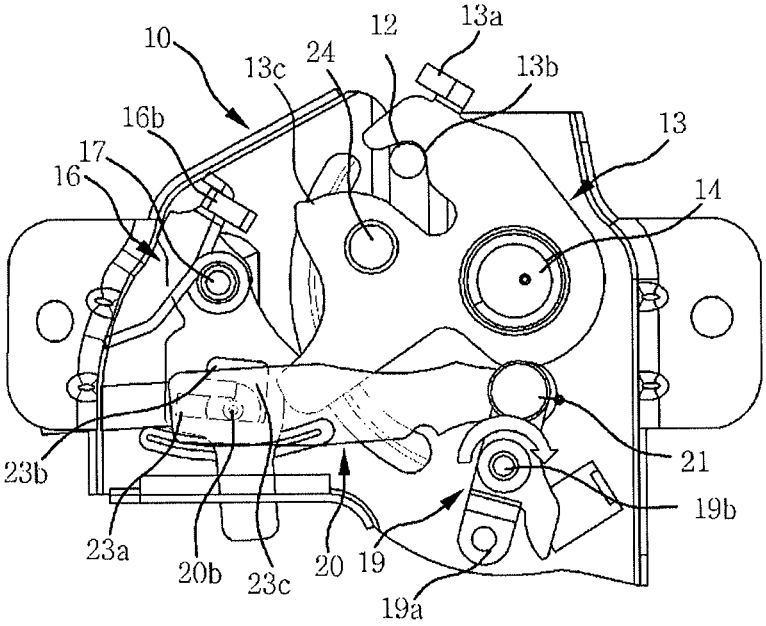
FIG. 9 is a view illustrating an operational state of an exemplary two step link hood latch apparatus when the hood is opened in FIG. 2.

FIG. 9 is a view illustrating an operational state of a two step link hood latch apparatus when the hood is opened in FIG. 2.

Figure 10:
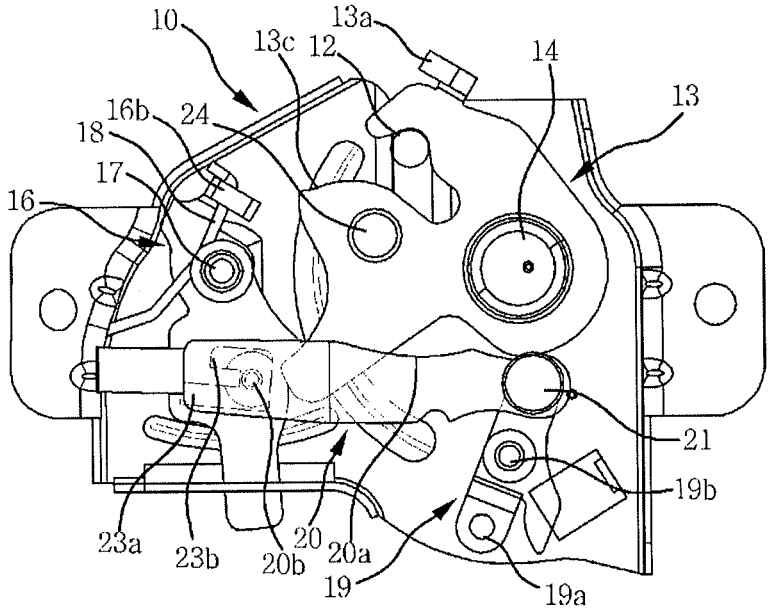
FIG. 10 is a view illustrating an operational state of an exemplary two step link hood latch apparatus when the hood is opened in FIG. 2.

FIG. 10 is a view illustrating an operational state of a two step link hood latch apparatus when the hood is opened in FIG. 2.

Figure 11:
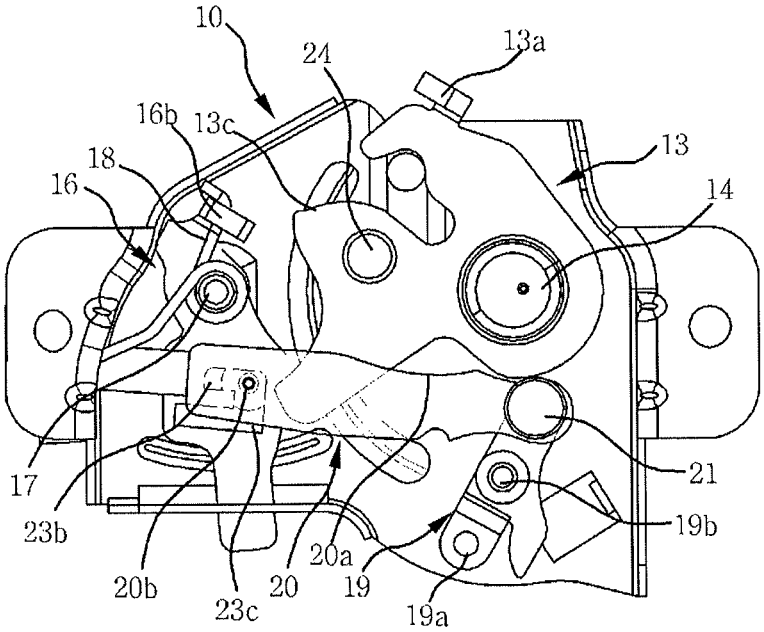
FIG. 11 is a view illustrating an operational state of an exemplary two step link hood latch apparatus when the hood is opened in FIG. 2.

FIG. 11 is a view illustrating an operational state of a two step link hood latch apparatus when the hood is opened in FIG. 2.

Figure 12:
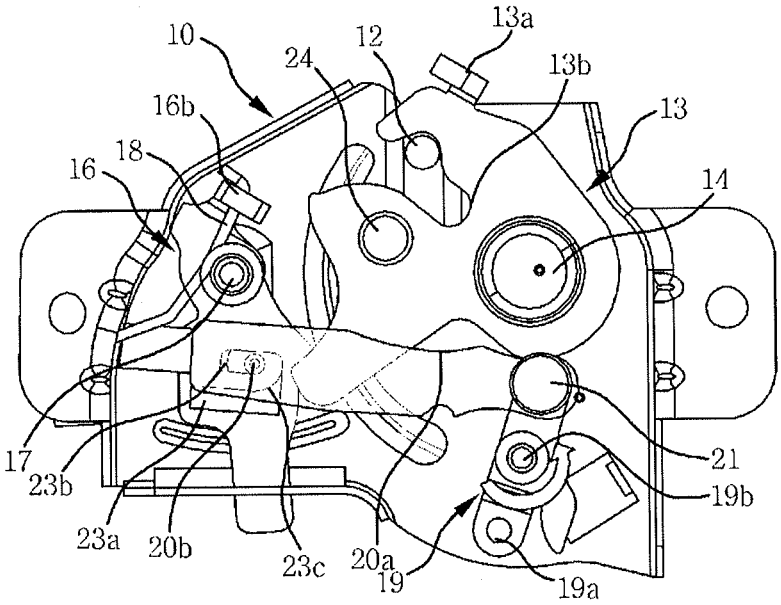
FIG. 12 is a view illustrating an operational state of an exemplary two step link hood latch apparatus when the hood is opened in FIG. 2.

FIG. 12 is a view illustrating an operational state of a two step link hood latch apparatus when the hood is opened in FIG. 2.

Figure 13:
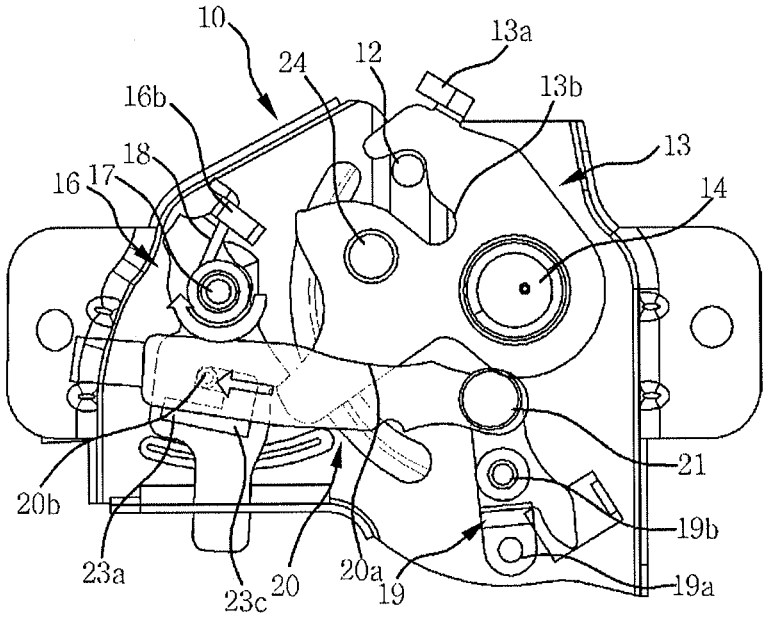
FIG. 13 is a view illustrating an operational state of an exemplary two step link hood latch apparatus when the hood is opened in FIG. 2.

FIG. 13 is a view illustrating an operational state of a two step link hood latch apparatus when the hood is opened in FIG. 2.

Figure 14:
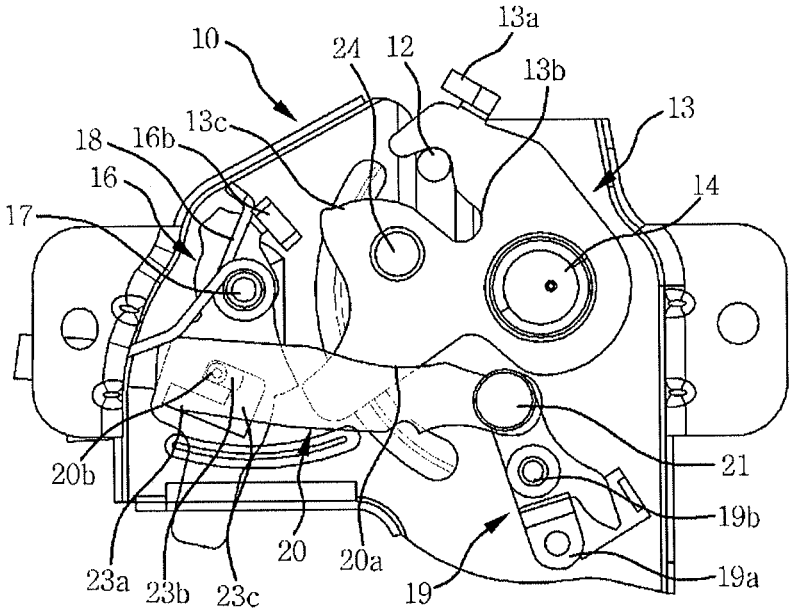
FIG. 14 is a view illustrating an operational state of an exemplary two step link hood latch apparatus when the hood is opened in FIG. 2.

FIG. 14 is a view illustrating an operational state of a two step link hood latch apparatus when the hood is opened in FIG. 2.

Figure 15:
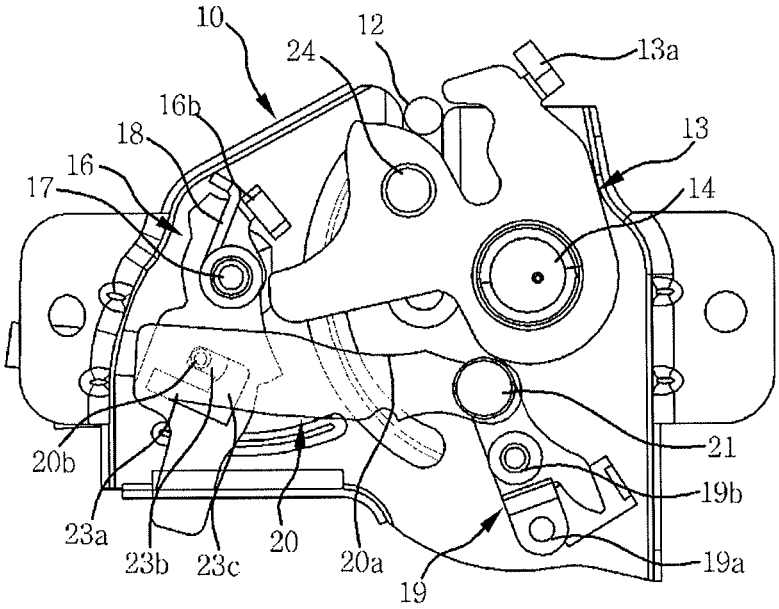
FIG. 15 is a view illustrating an operational state of an exemplary two step link hood latch apparatus when the hood is opened in FIG. 2.

FIG. 15 is a view illustrating an operational state of a two step link hood latch apparatus when the hood is opened in FIG. 2.

Figure 16:
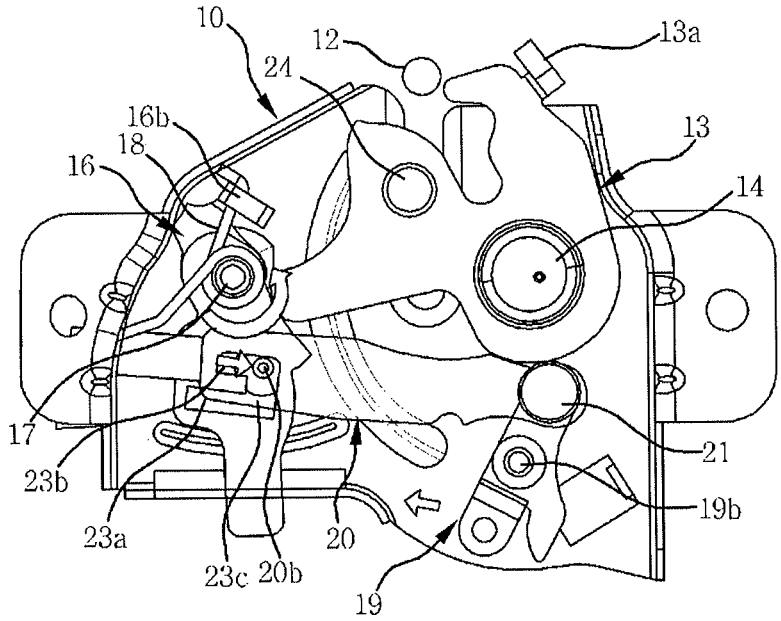
FIG. 16 is a view illustrating an operational state of an exemplary two step link hood latch apparatus when the hood is opened in FIG. 2.

FIG. 16 is a view illustrating an operational state of a two step link hood latch apparatus when the hood is opened in FIG. 2.

First, in order to open the hood, when a driver pulls out the release handle installed at the driver's seat inside the vehicle, its force may be applied to the lower part of the pivot 19 connected through the cable in the right direction and then may pull the lower part of the pivot 19.

When the lower part of the pivot 19 is pulled to the right through the force generated from the release handle, the upper part of the pivot 19 may rotate to the left on the basis of the pivot axis 19*b* at the center of the pivot 19, and thus, may move the link 20 to the left.

In this case, since the link groove 20*a*, which is concavely formed at the upper surface of the link 20 with a smooth downward curvature, contacts the outer circumference of the link restraint member 24, it may restrain the upward rotation of the link 20 and may convert the rotary motion of the pivot 19 into the linear motion of the link 20.

Then, when the link 20 contacts the left end at the middle of the first step slot of the pawl 16 to push the pawl 16 to the left due to the force delivered through the pivot 19, the lower part of the pawl 16 may rotate to the left, and thus, as the stop protrusion 16*a* of the pawl 16 rotates to the left, the first stop end 13*c* of the claw 13 previously stopped by the stop protrusion 16*a* may be released from the first step lock.

Then, the claw 13 may rotate upwardly due to the elastic restoring force of the first spring 15, and thus, the second stop end 13*d* of the claw 13 may be stopped by the stop protrusion 16*a*. Accordingly, the claw 13 may become a second step lock state.

In this case, while the claw 13 rotates upwardly, the link restraint member 24 attached to the claw 13 may rotate upwardly, so that the link groove 20*a* at the upper part of the link 20 may be released from the link restraint member 24.

Next, when the release handle is released in the second stop lock state, as the force passed from the release handle to the pivot 19 is released, the lower part of the pivot 19 may rotate in a counterclockwise direction due to the elastic restoring force of the third spring 22, and the upper part of the pivot 19 may rotate in a clockwise direction. As a result, as the link 20 connected to the upper part of the pivot 19 horizontally moves to the right, the operation axis 20*b* at the left end part of the link 20 may move from the left end part of the first step slot 23*a* of the pawl 16 to its middle again, and may pass through the middle of the first step slot 23*a*. By doing so, the operation axis 20*b* may rise from the first step slot 23*a* to the second step slot 23*b* through the connection slot 23*c* of the pawl 16, due to the elastic restoring force of the third spring 22.

Thereafter, when a driver pulls the release handle for the second time, due to the force passed through the wire, as the lower part of the pivot 19 is pulled to the right again and the upper part of the pivot 19 rotates to the left, the link 20 may horizontally move to the left.

Then, the operation axis 20*b* at the left end part of the link 20 may move to the left along the second slot 23*b* so as to contact the left end part of the second step slot 23*b*, thereby rotating the pawl 16 to the left.

Thus, as the stop protrusion 16*a* of the pawl 16 rotates to the left, the second stop end 13*d* of the claw 13 may be released from the stop protrusion 16*a*, and thus, the claw 13 may further rotate to the right. Accordingly, the insertion groove 11 of the claw 13 may be opened upwardly, and also the hood striker 12 may be completely released from the insertion groove 11 of the claw 13. Finally, the hood may be opened upwardly.

As described above, the operational state of the two step link hood latch apparatus is described when the hood is opened. An operating order when the hood is closed is the reverse order of the hood opening. However, when the hood is closed, since an operation of the release handle is not required, as the pawl 16 rotates due to the downward pressing force generated from the hood striker 12, the link 20 and the pivot 19 may operate.

Accordingly, according to the present invention, a safety lever of an existing hood may be removed, and a two step locking function may be performed on the hood latch itself through the guide slot 23 and the link 20 of the pawl 16 and the link restraint member 24 and the pivot 19 of the claw 13 in order to open the hood through the two step operation of the release handle inside a vehicle. Accordingly, existing inconvenience in putting the hand in an engine room to operate the safety lever in order to open the hood may be removed and merchantability may be improved.

Additionally, first step and second step strokes may be adjusted through the first step slot 23*a* and the second step slot 23*b* of the pawl 16, and the pivot 19 and the link 20 may be connected to a wire connected to the release handle in order to deliver the force occurring at the release handle to the pawl 16 through the pivot 19 and the link 20, so that operability of the release handle may be constantly implemented.

A two step link hood latch apparatus for vehicle according to the present invention has the following advantages.

First, a safety lever of an existing hood is removed, and a two step locking function is performed on a hood latch itself through a slot and a link of a pawl, and a link restraint member and a pivot of a claw, in order to open the hood through the two step operation of a release handle inside a vehicle. Accordingly, existing inconvenience in putting the hand in an engine room to operate the safety lever in order to open the hood is removed and merchantability may be improved.

Second, first step and second step strokes are adjusted through a first step slot and a second step slot of a pawl, and a pivot and a link are connected to a wire connected to a release handle in order to pass the force occurring at the release handle to the pawl through the pivot and link, so that operability of the release handle may be constantly implemented.

Third, pedestrian protection performance may be improved by removing an existing safety lever.

For convenience in explanation and accurate definition in the appended claims, the terms upper or lower, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A two step link hood latch apparatus for a vehicle, which allows a hood to be opened only with an operation of a release handle inside the vehicle, the apparatus comprising:

a claw having a stop groove, a first stop end and a second stop end, the claw being rotatably disposed at a base plate, wherein the stop groove, the first stop end, and the second stop end are on a same outer circumferential surface of the claw and wherein a hood striker is movably received in the stop groove;

a pawl rotatably disposed at the base plate and directly restraining rotation of the claw at first and second step lock states by engaging the first stop end and the second stop end of the claw, respectively;

a pivot rotatably disposed at the base plate in a hinge structure and transmitting a pulling force generated from the release handle; and a link connecting the pivot and the pawl and rotating the pawl in linkage with the pivot, wherein the pawl comprises a first step slot and a second step slot formed to be substantially parallel to each other and a connection slot to be substantially perpendicular to the first step slot and the second step slot, the first step slot selectively unlocking the first stop end of the claw in the first step lock state and the second step slot selectively unlocking the second stop end of the claw in the second step lock state;

wherein the link has an operation protrusion engaged into one of the first step slot, the connection slot and the second step slot and moving along the first step slot, the connection slot, or the second step slot; and wherein the first step lock state between a stop protrusion of the pawl and the first stop end of the claw is released by a rotation of the pawl when the operation protrusion of the link pushes one end of the first step slot of the pawl due to the force delivered through the pivot, and the second step lock state between the stop protrusion of the pawl and the second stop end of the claw is released by a rotation of the pawl when the operation protrusion of the link pushes one end of the second step slot of the pawl due to the force delivered through the pivot.

2. The two step link hood latch apparatus of claim 1, wherein:

the rotation of the pawl is adjusted by adjusting a stroke of the link through lengths of the first step and second step slots.

3. The two step link hood latch apparatus of claim 1, wherein the link is connected to the pivot by using a third rotation axis as a medium, and the pivot converts a rotary motion of the pivot into a horizontal linear motion of the link to operate the pawl.

4. The two step link hood latch apparatus of claim 1, wherein:

the link has a link groove formed concavely on an upper surface with a smooth curvature;

the claw has a circular link restraint member; and the link restraint member contacts the link groove to restrain the link.

5. The two step link hood latch apparatus of claim 1, wherein the link has a third spring disposed at a connection with the pivot, and moves the operation protrusion of the link from the first step slot to the second step slot by using the third spring.

* * * * *